US005487374A

United States Patent [19]

Herminath et al.

[11] Patent Number: 5,487,374

[45] Date of Patent: Jan. 30, 1996

[54] BOW STABILIZER

[76] Inventors: Michael Herminath, 806 N. Water, New London; Richard Wolfrath, Hwy. 45 S., both of New London, Wis. 54961

[21] Appl. No.: 269,776

[22] Filed: Jul. 1, 1994

[51] Int. Cl.[6] ..... F41B 5/14

[52] U.S. Cl. ..... 124/86; 124/89

[58] Field of Search ..... 124/1, 23.1, 25.6, 124/86, 88, 89

[56] References Cited

U.S. PATENT DOCUMENTS

| | | | |
|---|---|---|---|
| 3,208,653 | 9/1965 | Wallace | 124/23.1 X |
| 3,416,220 | 12/1968 | Wilson | 124/23.1 X |
| 3,998,367 | 12/1976 | Harding | 124/23.1 X |
| 4,103,807 | 8/1978 | Lyon et al. | 124/23.1 X |
| 4,121,743 | 10/1978 | Burton | 124/88 X |
| 5,065,732 | 11/1991 | Smith | 124/88 |
| 5,165,584 | 11/1992 | Meagher et al. | 124/88 X |
| 5,239,976 | 8/1993 | Specht | 124/88 |
| 5,277,170 | 1/1994 | Carella | 124/86 |
| 5,351,867 | 10/1994 | Vest | 124/89 X |

*Primary Examiner*—John A. Ricci
*Attorney, Agent, or Firm*—Russell L. Johnson

[57] ABSTRACT

A device for assisting a bowman in positioning and holding his bow in a draw by causing the plane of the bow to be drawn into a vertical plane and also by providing a steady rest for maintaining a stable position while in the draw. The device is a tether secured at one end to the lower limb of a bow and secured at the other end to the lower leg or foot of a bowman.

24 Claims, 7 Drawing Sheets

BOW STABILIZER

FIELD

This invention relates to a stabilizer for bows.

BACKGROUND

A bow and arrow as a means for launching a projectile at a distant target has been used by man for thousands of years. The bow and arrow suffers from inherent accuracy deficiencies due to the mechanics of drawing the bow and launching the arrow. If the bow is not drawn to the same position each time the bow is drawn, the flight path of the arrow launched from the bow will be changed each time the arrow is released. The mechanics of drawing and aiming a bow and arrow are such that it is difficult to hold the bow steady when the bow is fully drawn.

Numerous, generally failed, attempts have been made to aid the bowman in developing a consistent draw and/or to provide a steady-rest for a bowman while holding a bow in the drawn position.

OBJECTS

It is, therefore, an object of this invention to provide a bow stabilizer that is both a bow positioning aid and steady rest.

It is further an object of this invention to provide the bow stabilizer described above wherein the stabilizer is adaptable to many shooting stances and styles and attachable to many bow constructions, and usable by bowmen who are either right or left handed.

It is further an object of this invention to provide the bow stabilizer described above wherein the elements that make up the bow stabilizer are of low cost and easy to use.

Other objects will become apparent from the following specifications, claims and drawings.

PRIOR ART

The prior art does not teach a bow stabilizer that serves as a bow positioner and steady-rest that comprises; a flexible tether attached at one end to the lower limb of a bow and attached at the other end to the lower part of a leg of an archer.

The prior art does recognize the problems solved by the stabilizer of this invention, and further, the prior art does teach the use of most of the elements of this invention in the archery related arts.

The long held knowledge of the problems solved by the bow stabilizer of this invention and the many failed attempts to solve those problems, along with the presence in the art of the means to create the bow stabilizer of this invention, all argue for the conclusion that the bow stabilizer of this invention is novel and unobvious.

U.S. Pat. No. 5,065,732 to Smith, recognizes the difficulties encountered by archers in ". . . maintaining the bow in a steady state condition while aiming and firing an arrow.". Smith teaches a bifurcated elastic sling that attaches to both limbs of a bow and to the neck and shoulder area of an archer's body.

U.S. Pat. No. 5,277,170 to Carella, teaches the use of a remote anchor to promote the shooting accuracy of a bowman.

U.S. Pat. No. 5,165,584 to Meagher et al teaches the use of Velcro (TM) hook and loop fasteners, straps, sliding clips, buckles, and quick release couplings in association with an archer's carrying and shooting aid.

To the inventor's knowledge, throughout the years, from antiquity until today, no one, before him, has employed the apparatus and method of this invention to provide a bow stabilizer of the type disclosed herein to provide a positioner and steady-rest for an archer.

BRIEF DESCRIPTION

The stabilizer of this invention in its simplest form comprises a tether having a first end and a second end and said first end is attached to the lower limb of a bow and said second end is attached to a lower part of the leg of a bowman.

DETAILED DESCRIPTION

Figure 1:
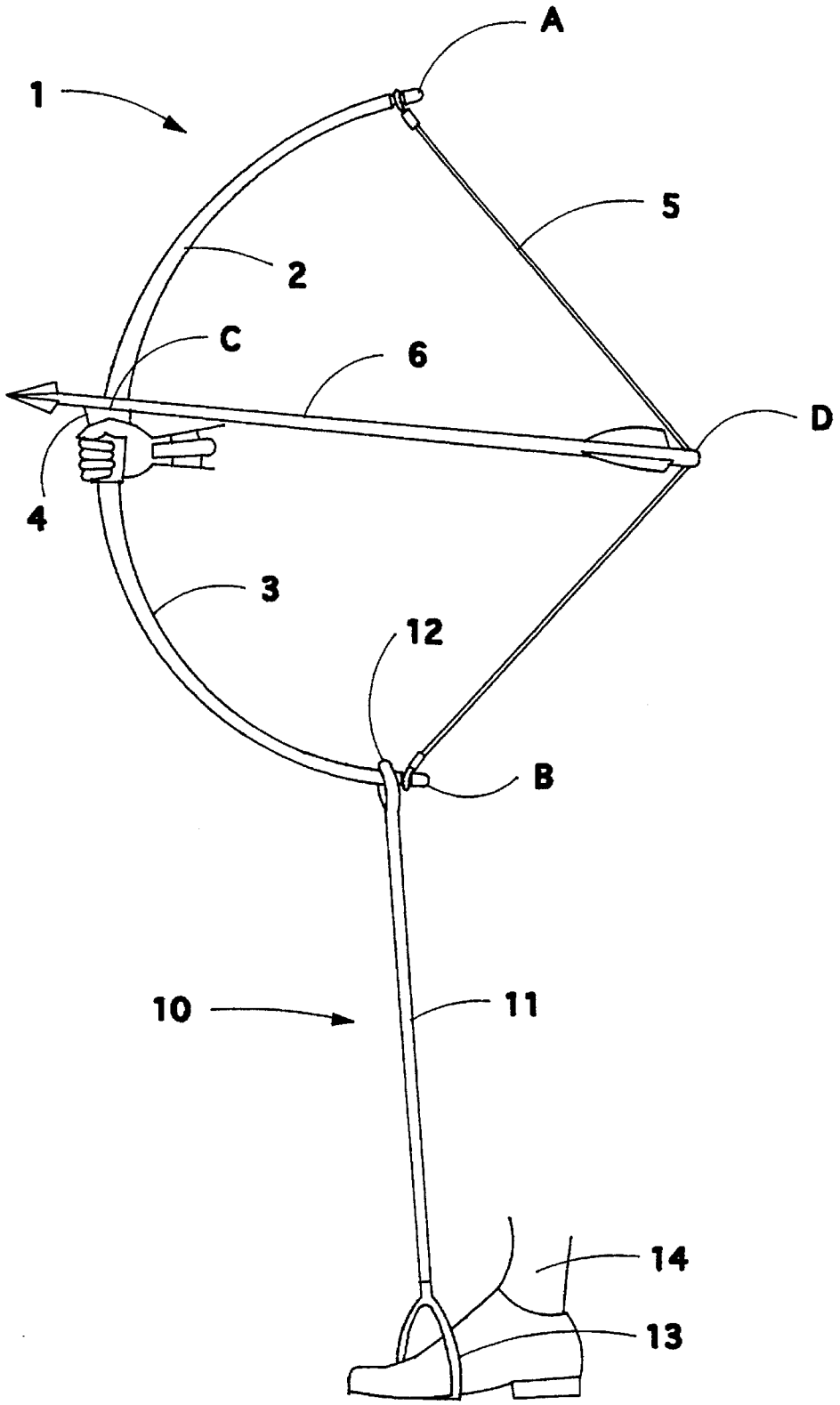
FIG. 1 is a schematic elevational view showing the essential elements and structures of the bow stabilizer of this invention

In the drawings like numbers refer to like objects and the proportions of some elements of the drawings have been changed to facilitate illustration.

The term "tether" as used herein shall be read to mean, "a means for tying or restraining within certain limits".

The term "foot" as used herein shall be read to mean; "the foot, the ankle, and that portion of the lower leg commonly covered by a hunting boot".

The bow stabilizer and positioner of this invention is adaptable for use with nearly all styles and kinds of hand drawn bows. Therefore, Bow 1 of the figures should be regarded as a generic bow and not be restricted to the representation given bow 1 in the figures.

Referring now to FIG. 1 wherein the invention is shown in its simplest form. Bow 1 has upper limb 2 and lower limb 3 joined at grip 4. The upper tip A of upper limb 2, the lower tip B of lower limb 3 and the arrow rest C of grip 4 define 3 points that define the plane of the bow. Hereinafter, plane ABC shall be called the plane of the bow. In the shooting configuration arrow 6 defines a line C–D between arrow rest C on bow 1 and knock point D on bow string 5. Line C–D shall, hereinafter be called the line of the draw. When bow 1 is drawn as shown in FIG. 1, point D lies in the plane of the bow due to the tension in bow string 5 drawing a line between points A and B into intersection with the line of the draw.

The flight of an arrow is determined by its velocity and the vertical pull of gravity. In order for an arrow to follow a true flight path, the flight line must be initiated while the plane of the bow is vertical. A problem that has plagued bowmen through the years is that of canting the bow. This common error is brought about by the plane of the bow being rotated around the line of the draw and out of vertical. The stabilizer of this invention serves to bring the plane of the bow into a vertical plane.

Because of the dynamics of drawing and shooting a bow and arrow, heretofore there has not been a practical way to provide a steady-rest for bringing a bow to a fixed position and holding it there. The bow stabilizer of this invention provides such a steady-rest.

The above two benefits of the stabilizer of this invention serve to enable even inexperienced bowmen to achieve a much higher degree of consistency and accuracy of shooting than would be otherwise obtainable without the benefits of the bow stabilizer of this invention.

FIG. 1 illustrates bow stabilizer 10 of this invention in one of its simplest forms. A first end of flexible tether 11 is attached at attachment point 12, to lower limb 3 of bow 1. A second end of tether 11 is attached at attachment point 13 on foot 14 of a bowman. Attachment point 13 is shown in FIG. 1 to be a stirrup into which a bowman's foot is insertable.

In use a bowman raises the bow until it creates a tension in flexible tether 11. This causes the plane of bow 1 to come into a vertical attitude. An upward pressure is maintained in tether 11 thereby stabilizing and fixing the bowman's hold of the draw. In normal shooting a bowman has his feet planted on the floor or ground, both of which are stable fixed references to which a steady-rest can reliably be taken. The resulting consistently reproducible positioning and stable holding of the draw results in markedly superior shooting accuracy and consistency over that which would be achieved by the same bowman absent the bow stabilizer of this invention.

The above disclosures are enabling and would permit one skilled in the art to make and use the bow stabilizer of this invention without undue experimentation.

However, the bow stabilizer of this invention admits of numerous variations and embodiments, some of the more important of which are disclosed hereinafter.

Figure 2:
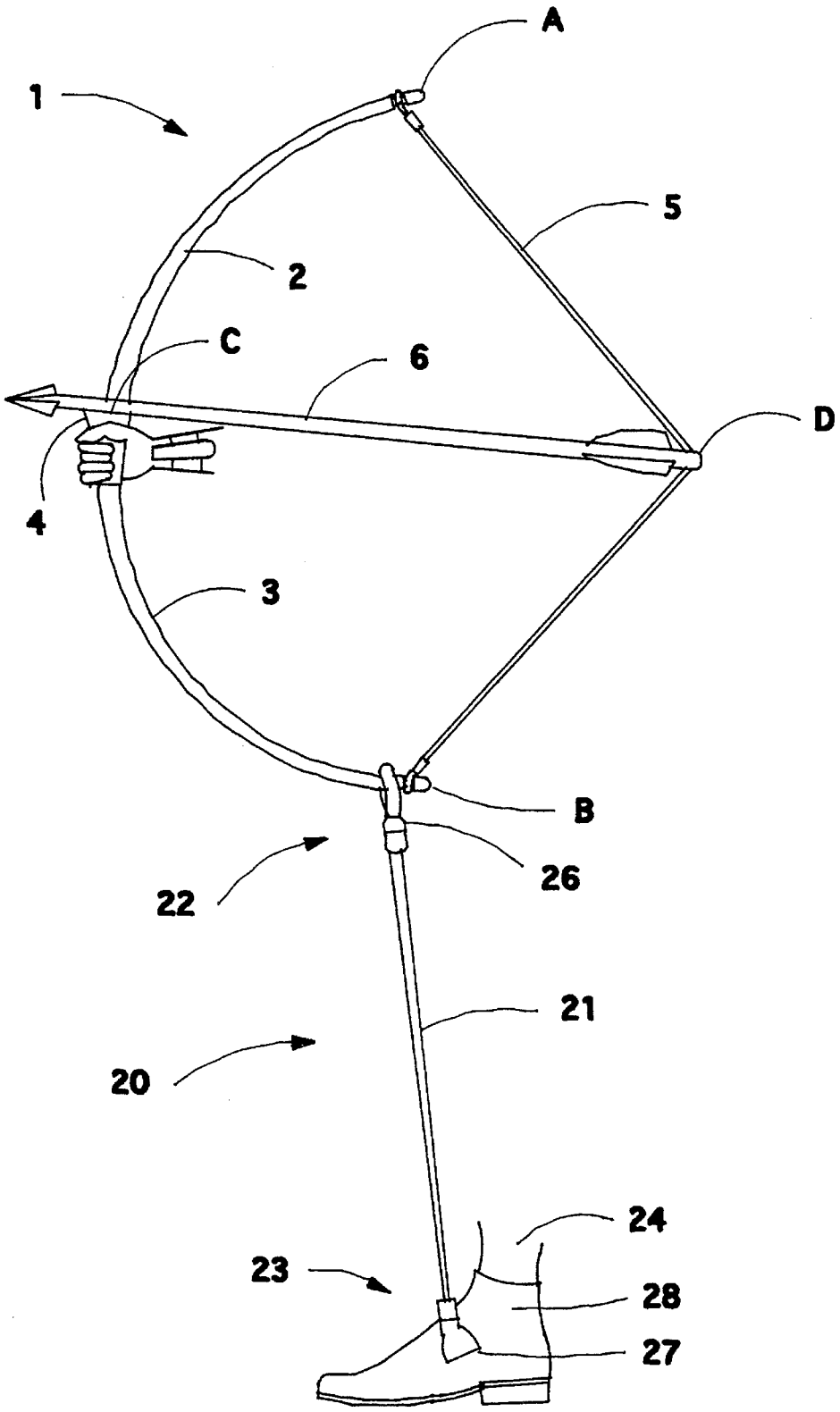
FIG. 2 is a schematic elevational view of the stabilizer of FIG. 1 wherein releasable couplings are provided for joining a tether to a bow.

Referring now to FIG. 2 wherein bow stabilizer 20 comprises flexible tether 21 which is joined with bow 1 by means of a separable bow coupling 22 and is joined to the lower leg 24 of a bowman by separable foot coupling 23. The tie and belting art is replete with separable couplings that can serve as couplings 22 and 23.

Separable couplings 22 and 23 permit the exchange of an inelastic tether 21 for an elastic tether 21', (not shown). An inelastic tether 21 better serves a bowman shooting on a range wherein a premium is placed upon consistent positioning of bow 1. An elastic tether 21' is of utility in field shooting wherein the bowman is called upon to adjust positioning to compensate for distances to targets and for unevenness of terrain.

Bow member 26 of coupling 22 may be in the form of an attachment to the bow as shown in FIG. 2 or it may be incorporated into the bow structure.

Foot member 27 of coupling 23 may be incorporated into the structure of a bowman's footwear 28 as shown in FIG. 2.

Figure 3:
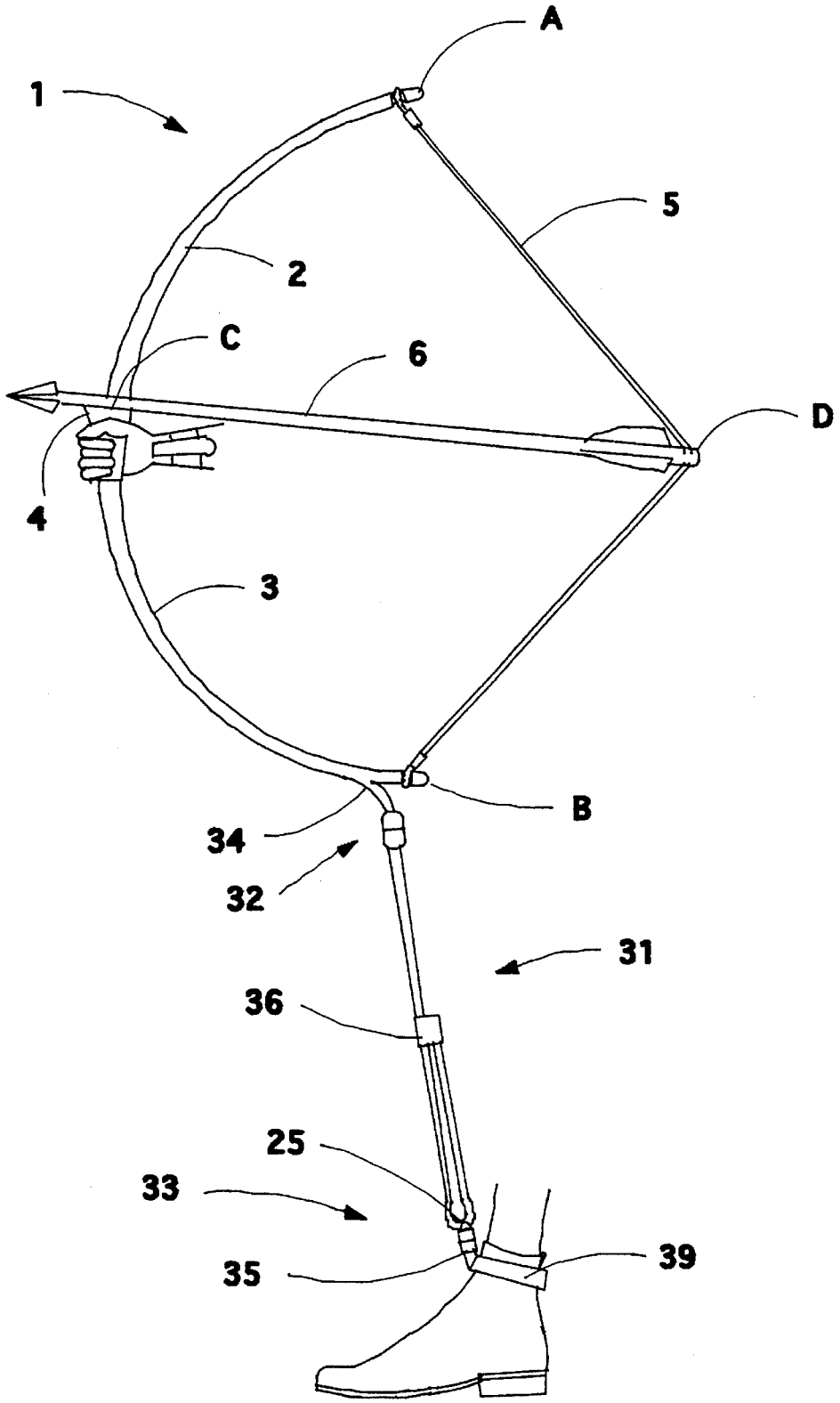
FIG. 3 is a schematic elevational view of the stabilizer of FIG. 1 wherein the tether is made adjustable.

Referring now to FIG. 3 wherein bow member 34 of releasable coupling 32 is shown as a part of the construction of bow 1, and foot member 35 of releasable coupling 33 is a part of of an ankle band 39 which encircles the ankle of a bowman. Tether 31 is adjustable. The art is replete with buckles and slides such as slide 36 that will serve to render tether 31 adjustable.

The adjustability of tether 31 permits the accommodation of the bow stabilizer of this invention to variations in bow construction and bowman configurations. Further, the adjustability of tether 31 permits the storing of tether 31 against bow 1 and the employment of tether 31 as a carrying strap.

Figure 4:
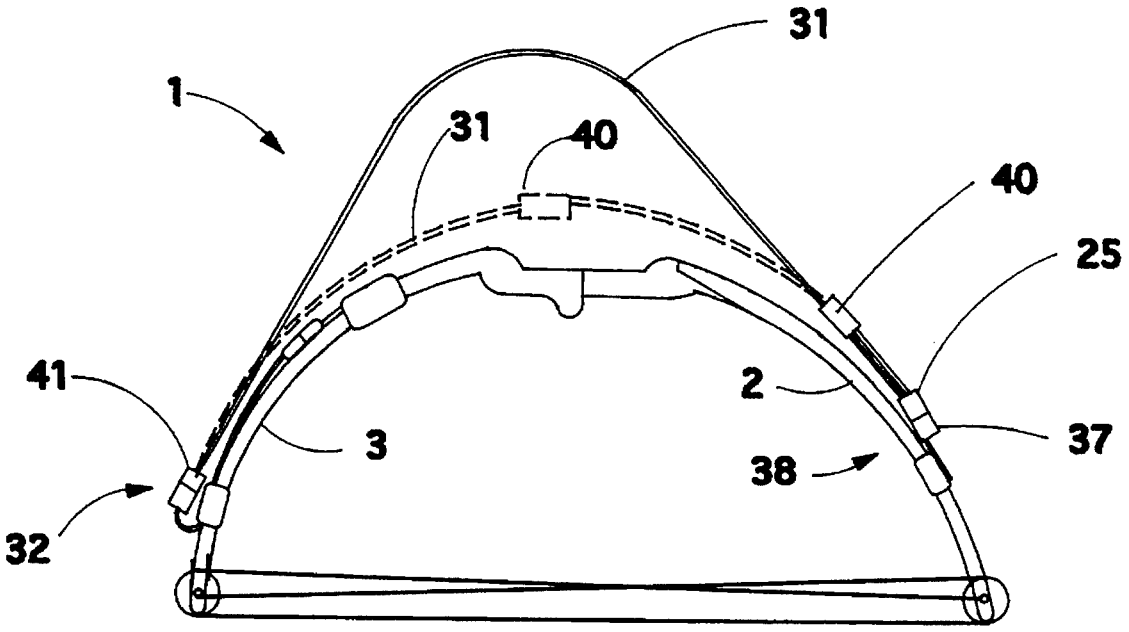
FIG. 4 is a an elevational view of a bow provided with the stabilizer of this invention wherein the tether is configured to serve as a carrying sling.

Referring now to FIG. 4 wherein bow 1 is shown as a compound bow, and tether 31 is joined to lower limb 3 by releasable coupling 32 and tether foot member 25 is connectable with upper limb coupling member 37 secured to upper limb 2 to form upper limb coupling 38. Adjustment clip 40 serves to permit the adjustment of the length of flexible tether 31 between tether foot end member 25 and bow member 41 of bow coupling 32. The art is replete with buckles, slides and clips that can serve as adjustment clip 40. When the length of tether 31 is extended, as shown in solid lines in FIG. 4, tether 31 is in the configuration of a carrying sling. When the length of tether 31 is shortened as shown in dashed lines in FIG. 4, tether 31 is in a storage configuration.

The tension in the tether should be applied near the end of the lower limb of the bow to optimize the tendency of the tension to position the plane of the bow in a vertical plane. However, it is also desirable that the tension in the tether be applied just below the hand so as to minimize the tendency of the tension in the tether to cause the bow to rotate about the hand in the plane of the bow. Both of these desirable ends can be achieved by the bow stabilizer of this invention.

Figure 5:
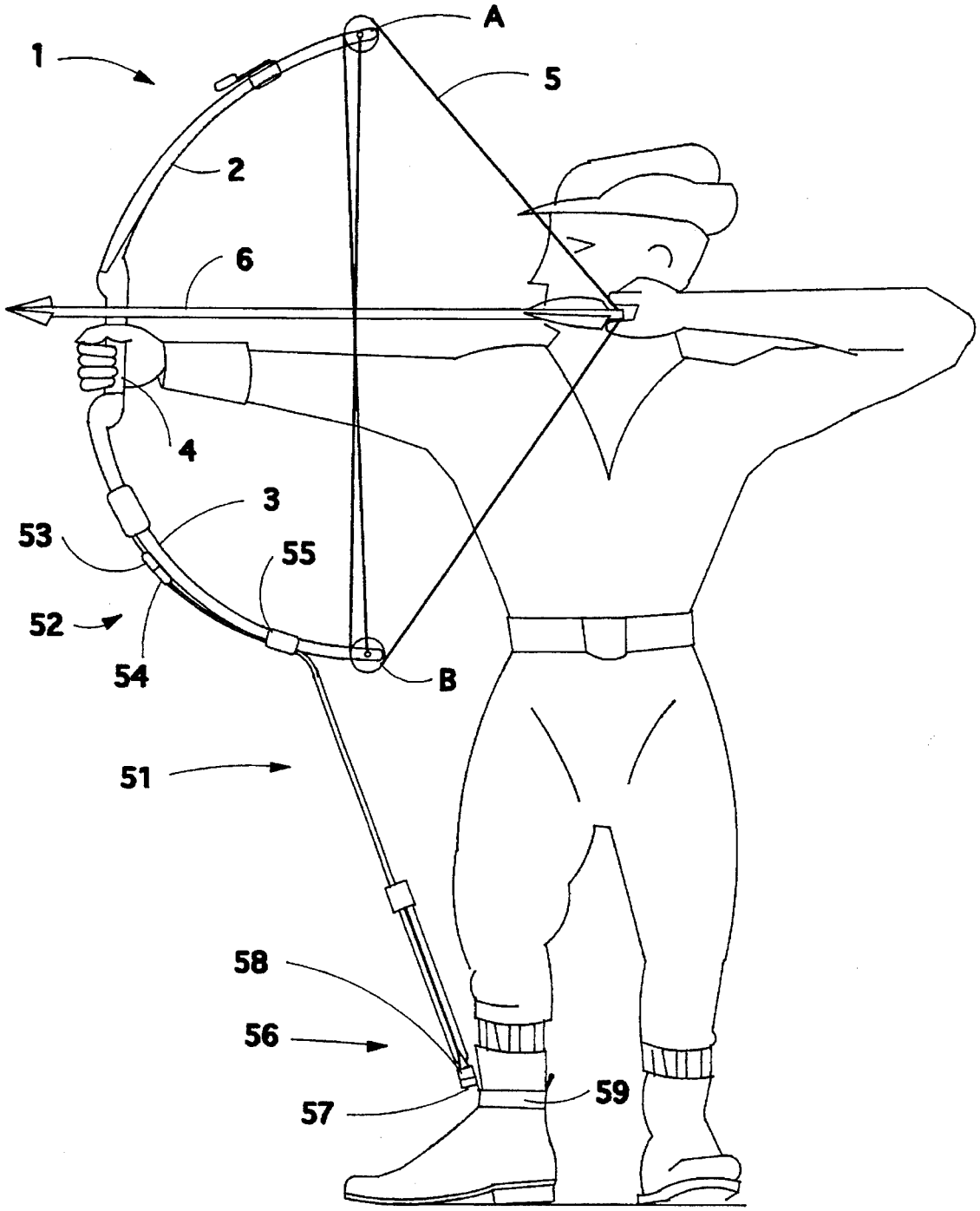
FIG. 5 is an elevational view of a bowman employing a bow stabilizer made according to this invention wherein the elements and structures shown represent the best mode for practicing the invention contemplated by the inventor at the time of the preparation of this application.

Referring now to FIG. 5 wherein lower limb 3 of bow 1 has secured to its outer end a sleeve 55. Tether 51 is slidably engaged with sleeve 55. A bow member 53 of a bow coupling 52 is secured to limb 3 below grip 4 of bow 1. Tether 51 is joined to bow member 53 of bow coupling 52 by means of tether bow member 54. Tether 51 is joined to foot member 57 of foot coupling 56 by means of tether foot member 58 attached to tether 51. Foot member 57 is shown in FIG. 5 as being a part of ankle band 59 which encircles the ankle of the bowman.

In use, a bowman equips his bow with a bow stabilizer made according to this invention. In preparation for firing an arrow, the bowman connects the flexible tether of this invention between the lower limb of his bow and the lower portion of his leg. The arrow is nocked and the bow is raised to the firing position so as to create a tension in the tether. The tension in the tether urges the plane of the bow into a vertical plane and the tension in the tether serves as a steady-rest for the bow during aiming and launching of the arrow.

The above disclosures teach the invention; the general structures, mechanisms, and combinations of elements that are of utility in practicing the invention; and the method of putting the invention into practice. The following disclosures teach specific combinations of structures, mechanisms, and assemblies that employ materials, and technologies that are available in the art, so as to enable the bringing of the invention into practical commercial practice.

Figure 6:
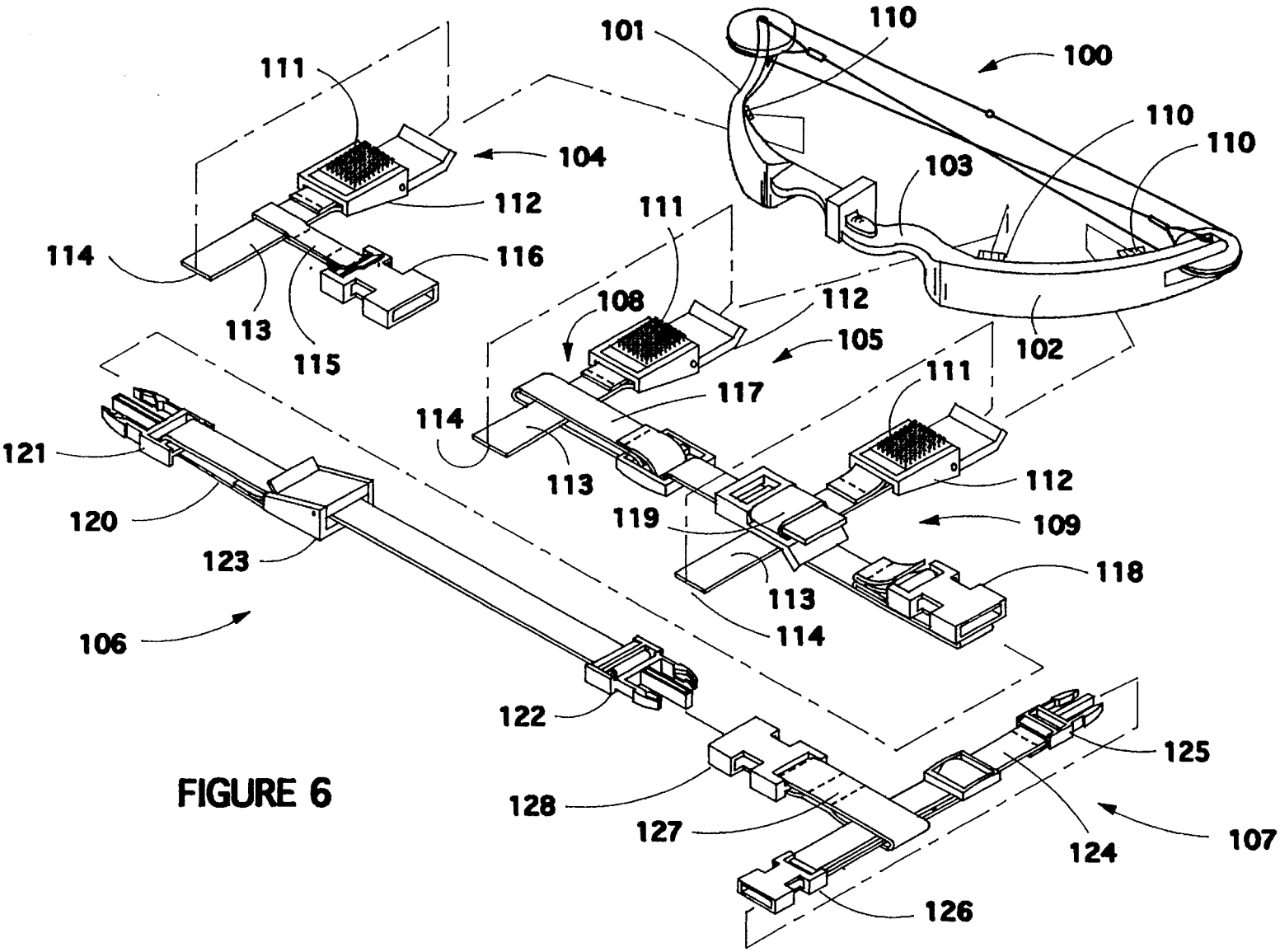
FIG. 6 is a partially schematic exploded view of the elements of FIG. 5 wherein the scale of the bow has been reduced relative to the other elements for the sake of illustration.
Figure 7:
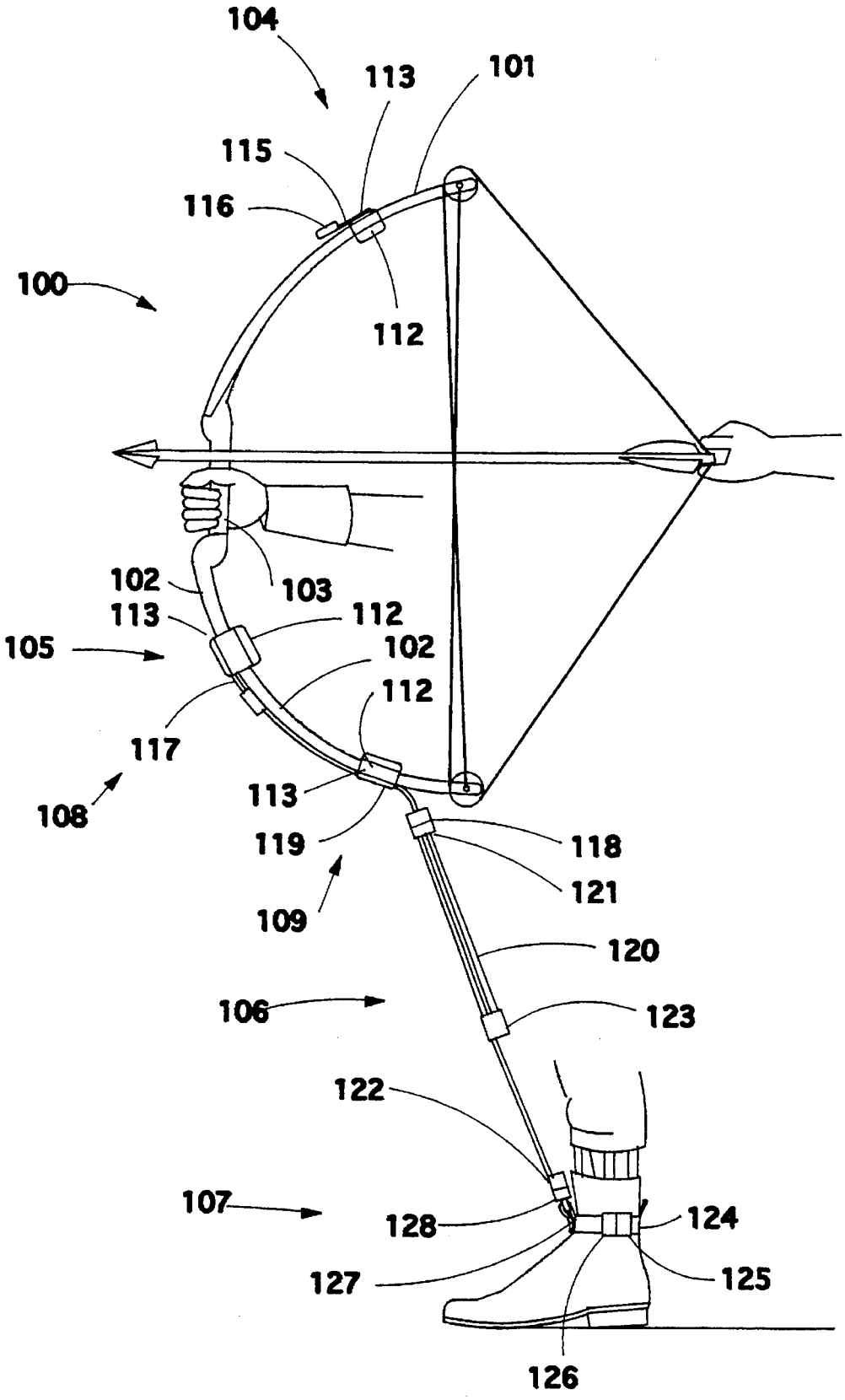
FIG. 7 is a view similar to that of FIG. 5 wherein the specific elements of FIG. 6 are shown.

FIGS. 6 and 7 represent the best mode of practicing the invention known to the inventors at the time of filing of this patent application. FIG. 6 is an exploded view of structures and assemblies that combine to provide a bow stabilizer and positioner made according to this invention.

Referring now to FIGS. 6 and 7 wherein a preferred embodiment of the invention is shown. Bow 100 has upper limb 101, and lower limb 102 which are joined at grip 103. A bow stabilizer and positioner is formed of four assemblies; an upper bow assembly 104, a lower bow assembly 105, a tether assembly 106 and a foot assembly 107. Lower bow assembly 105 is formed of two subassemblies; a strap attachment assembly 108 and a guide assembly 109.

Hook and loop fasteners such as, Velcro (T.M.) a product of the 3M Company of Minneapolis, Minn., serve to detachably secure upper bow assembly 104 and lower bow assembly 105 to bow 100. First fastener members 110 are attached to bow limbs 101 and 102 as shown. Second fastener members 111 are attached to locking clips 112 which are at one end of bow straps 113. To assemble the bow related structures to bow 1, second attachment members 111 are engaged with first attachment members 110 and bow straps 113 are wrapped around bow limbs 101 and 102 and thereafter, free ends 114 of straps 113 are inserted into locking clips 112 and locked in place, thereby positionally locating and detachably securing upper bow assembly 104 and lower bow assembly 105 to bow 100.

Upper bow assembly 104 is attached to upper limb 101 of bow 100 at a location away from grip 103, strap assembly 108 is attached to lower limb 102 of bow 100 at a location near grip 103, and guide assembly 109 is attached to lower limb 102 of bow 100 at a location away from grip 103. Upper coupling strap 115 is secured at one end to bow strap 113 of upper bow assembly 104 and has secured at its free end upper bow coupling member 116. Lower coupling strap 117 is secured at one end to bow strap 113 of strap assembly 108 and has secured at its free end lower bow coupling member 118. Bow strap 113 of guide assembly 109 has secured thereto guide 119. Lower coupling strap 117 passes through guide 119 and is slidably retained therein.

Tether assembly 106 has tether strap 120 which has secured to one end, tether bow coupling member 121. Tether strap 120 slidably passes through a part of tether foot coupling member 121 and is secured at its other end to locking clamp 123 which is slidably mounted on tether strap 120 thereby enabling the adjustment of the working length of tether assembly 106.

Foot assembly 107 has ankle strap 124 which has secured to one end, first ankle coupling member 125 and has secured at the other end, second ankle coupling member 126 and a foot coupling strap 127 which is secured at one end to ankle strap 124 and has secured to the other end, tether foot coupling member 128.

Ankle strap 124 is secured about the ankle of a bowman. Tether foot coupling member 122 is engaged with tether foot coupling member 128 and tether bow coupling member 121 is engaged with lower bow coupling member 118 to complete the assembly of the structural elements of the bow stabilizer and positioner of this embodiment of the invention.

The method of use of the bow stabilizer and positioner of FIGS. 6 and 7 is the same as that described above in relation to FIGS. 1–5.

The above disclosures are enabling so that one skilled in the art can make and use the bow stabilizer of this invention without undue experimentation. It should be noted that the bow stabilizer of this invention admits of numerous variations and embodiments. To recite these embodiments and variations would greatly multiply the drawings and cause the specifications and claims to become prolix.

Therefore, it should be understood that the scope of this invention should not be limited to the embodiments disclosed, but rather, the scope of the invention should be only limited to the scope of the appended claims and all equivalents thereto that would become apparent to one skilled in the art.

What is claimed is:

1. A bow stabilizer and positioner comprising;

a) a tether having a length, a bow end, and a foot end, b) said tether having said bow end provided with a means for connecting said tether to a lower limb of a bow, c) said tether having said foot end provided with a means for connecting said foot end to a foot of a bowman, and d) the length of said tether is such that said tether can be drawn taut by a bowman raising said bow to a firing position.

2. The stabilizer of claim 1 wherein the tether is a flexible tether formed of an elastic material.

3. The stabilizer of claim 1 wherein the tether is a flexible tether formed of an inelastic material.

4. The stabilizer of claim 1 wherein said means for connecting said bow end of said tether to said lower limb of a bow is a member of a separable coupling.

5. The stabilizer of claim 1 wherein said means for connecting said foot end of said tether to said foot of a bowman is a member of a separable coupling.

6. The stabilizer of claim 1 wherein the length of said tether is adjustable.

7. A bow stabilizer and positioner comprising;

a) a bow having at least a grip, an upper limb member extending from said grip, and a lower limb member extending from said grip, b) a tether having a length, a bow end, and a foot end, c) a means by which said bow end of said tether is attached to said lower limb of said bow, d) a means by which said foot end of said tether is attached to the foot of a bowman, and e) the length of said tether is such that said tether can be drawn taut by a bowman raising said bow to a firing position.

8. The bow stabilizer and positioner of claim 7 wherein said means for attaching said bow end of said tether to said lower limb of said bow is a separable coupling.

9. The bow stabilizer and positioner of claim 7 wherein said means of attaching said foot end of said tether to a foot of an archer is a separable coupling.

10. The bow stabilizer and positioner of claim 7 wherein said tether is formed of elastic material.

11. The bow stabilizer and positioner of claim 7 wherein said tether is formed of inelastic material.

12. The bow stabilizer and positioner of claim 7 wherein said tether is adjustable.

13. The bow stabilizer and positioner of claim 7 wherein, the means for attaching said bow end of said tether to said lower limb of said bow is a separable bow coupling having a bow coupling member secured to the lower limb of said bow and a tether bow coupling member secured to the bow end of said tether, and wherein the means for attaching said foot end of said tether to the foot of a bowman is a separable foot coupling having a foot coupling member secured to the foot of a bowman and a tether foot coupling member secured to the foot end of said tether.

14. The bow stabilizer and positioner of claim 13 wherein said bow coupling is secured near the lower tip of said lower limb of said bow.

15. The bow stabilizer of claim 13 wherein said bow coupling is secured to said lower limb of said bow near said grip, and said tether slidably passes through a guide loop secured near the lower tip of said lower limb of said bow.

16. The bow stabilizer of claim 15 wherein said upper limb of said bow has attached thereto an upper limb coupling member which is engageable with said tether foot coupling member secured to the foot end of said tether.

17. The bow stabilizer of claim 13 wherein the means for attaching said first foot coupling member to the foot of a bowman is by means of a band that encircles the ankle of the foot.

18. The bow stabilizer of claim 13 wherein the means for attaching said foot coupling member to the foot of a bowman is a means incorporated into the structure of an article of footwear which is worn on the foot of the bowman.

19. The bow stabilizer and positioner of claim 13 wherein the means for attaching said foot coupling member to the foot of a bowman is a stirrup means into which the bowman's foot is insertable.

20. A method for stabilizing and positioning a bow having at least, a grip, an upper limb, a lower limb, and comprising the steps of, 1) attaching a first end of a tether to the lower limb of the bow, 2) attaching a second end of said tether to the foot of a bowman, 3) engaging the grip by a hand of the bowman, 4) raising the bow until a tension is established in the tether, thereby bringing the bow into a vertical plane, 5) maintaining the tension in the tether while drawing the bow and releasing an arrow, thereby providing a steady-rest for stabilizing the vertical plane of the bow during the drawing of the bow and the releasing of the arrow.

21. A bow stabilizer and positioner for a bow having at least a grip, an upper limb extending from said grip, and a lower limb extending from said grip, said bow stabilizer and positioner comprising:

(a) a lower bow assembly having a strap assembly and a guide assembly, and the strap assembly is secured to the lower limb of the bow at a location near the grip, and the guide assembly is secured to the lower limb of the bow at a location away from the grip, and the strap assembly has attached thereto, a lower coupling strap that passes from the strap assembly through a guide which is a part of the guide assembly, and said lower coupling strap is slidably retained within said guide, and said lower coupling strap has secured at its free end a lower bow coupling member, (b) a tether strap which has a lower bow coupling member secured to one of its ends and the tether strap slidably passes through a guide in a foot coupling member and the other end of said tether strap is secured to a locking clip which is slidably mounted on said tether strap so as to form a tether whose working length is adjustable, and the tether bow coupling member is engageable with a bow coupling member on said bow, (c) an ankle strap which is secured around the ankle of a bowman and the ankle strap has secured thereto a foot coupling strap and said foot coupling strap has attached to a free end, a foot coupling member, and said foot coupling member of said ankle strap is engageable with said foot coupling member of said tether.

22. The bow stabilizer and positioner of claim 21 wherein the tether strap is elastic.

23. The bow stabilizer and positioner of claim 21 wherein the tether strap is inelastic.

24. The bow stabilizer and positioner of claim 21 wherein the lower bow assembly is detachably secured to the bow by means of separable hook and loop fasteners.

* * * * *